US006805591B2

(12) United States Patent
Garland et al.

(10) Patent No.: US 6,805,591 B2
(45) Date of Patent: Oct. 19, 2004

(54) CONTACT RETENTION SYSTEM FOR POWER CONTACTS

(75) Inventors: Michael Stephen Garland, Manheim, PA (US); Daniel Robert Ringler, Elizabethville, PA (US); James Charles Shiffler, Hershey, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/041,298

(22) Filed: Jan. 8, 2002

(65) Prior Publication Data

US 2003/0129881 A1 Jul. 10, 2003

(51) Int. Cl.[7] ..... H01R 13/40
(52) U.S. Cl. ..... 439/733.1; 439/856
(58) Field of Search ..... 439/733.1, 856, 439/857

(56) References Cited

U.S. PATENT DOCUMENTS 4,018,177 A * 4/1977 McKee et al. ..... 29/874
4,317,609 A * 3/1982 Lapraik ..... 439/733.1
6,383,039 B1 * 5/2002 Yoneyama et al. ..... 439/856

* cited by examiner

*Primary Examiner*—Renee Luebke

(57) ABSTRACT

A connector housing having a contact secured therein is provided. The connector housing includes inner walls that define a contact-receiving chamber. The contact-receiving chamber includes a channel along at least a portion of one of the inner walls for receiving a contact retention member. The contact-receiving chamber may include multiple channels for receiving multiple contact retention members. The contact includes a body section having the contact retention member thereon. The contact may include multiple body sections. The contact retention member includes a bulge portion flared outward in a direction transverse to the body section. The contact retention member may include multiple bulge portions and the multiple bulge portions may flare outward and inward in opposite directions from one another. When the contact is loaded into the housing and the contact retention member is received by the channel, the bulge portion frictionally engages at least one of the inner walls of the contact-receiving chamber. The frictional engagement of the bulge portion to at least one of the inner walls secures the contact within the connector housing.

5 Claims, 13 Drawing Sheets

CONTACT RETENTION SYSTEM FOR POWER CONTACTS

BACKGROUND OF THE INVENTION

Certain embodiments of the present invention generally relate to electrical contacts and to connector housings for electrical contacts, and more particularly, to apparatus for securing power contacts in connector housings.

Connector housings are designed to hold various types of contacts, including power and signal contacts. Power contacts are used for mid- to high-range servers (e.g., for power applications). Individual power contacts can accommodate up to 48 amps and 600 volts. When eight power contacts are aligned adjacent to one another in a connector housing, each power contact can accommodate 30 amps. Installed power contacts, as well as signal contacts, have solder tails that protrude downward from and out of the connector housing in a predefined pattern. Typically the connector housing and contacts are loaded or dropped onto printed circuit boards such that the solder tails fit through a corresponding pattern of holes in the printed circuit board and may protrude from the opposite side of the printed circuit board. The solder tails are then wave soldered to the printed circuit board.

Power contacts are presently manufactured with a latch that loosely secures the power contacts into a connector housing. The power contact is designed to only be loosely secured in the connector housing due to the combination of expected tolerances in the power contact and in the connector housing. When a power contact is installed, the latch moves into a window on the connector housing, thereby loosely securing the power contact in the connector housing. The tolerances allow for the power contact to travel into the connector housing beyond the final resting position of the power contact so that the latch can pop up into the window. Once the latch enters the window, the power contact can only slightly move rearward until the latch engages the window. The latch, upon engaging the window, restricts any further rearward movement of the power contact.

However, several disadvantages exist with the above noted power contact design, primarily stemming from the fact that the power contact, being loosely secured in the connector housing, remains free to move about within the connector housing after installation. First, the power contact moves within the connector housing when the connector housing is loaded onto the printed circuit board. Because of this movement, the solder tails of the power contacts may not properly align with and fall into the corresponding pattern of receiving holes on the printed circuit board. If loading the connector housing onto the printed circuit board is an automated process, then failure of the solder tails to properly align and fall into the corresponding pattern of receiving holes can result in defective products. If loading the connector housing onto the printed circuit board is a manual process, then failure of the solder tails to properly align and fall into the corresponding pattern of receiving holes, results in delays until the solder tails can be properly placed into the corresponding pattern of receiving holes.

Secondly, movement of the power contact interferes with wave soldering of the solder tails to the printed circuit board. During wave soldering, a wave of solder engages the ends of the solder tails that protrude through the underside of the printed circuit board. As the solder wave engages the solder tails, the solder tails are free to move up and down relative to the printed circuit board. Consequently, solder tails can be displaced upward and then be soldered to the printed circuit board without the ends of the solder tails fully protruding through the underside of the printed circuit board. If the ends of the solder tails do not fully protrude through the underside of the printed circuit board, it is harder to determine by visual inspection whether or not solder connections between the solder tails and the printed circuit board are defective.

The third problem is movement of the power contacts during mating and unmating of connector housings. Movement of the power contacts relative to the connector housing during mating or unmating can result in increased normal forces on the power contacts that can reduce the lifespan of the power contacts.

A need remains for an improved power contact and connection between the power contact and connector housing.

BRIEF SUMMARY OF THE INVENTION

An embodiment of the present invention provides a connector housing and a contact secured therein. The connector housing includes inner walls that define a contact-receiving chamber. The contact-receiving chamber includes a channel along at least a portion of one of the inner walls. The channel is tapered wider at its receiving end, allowing the channel to easily receive a contact retention member portion of the contact. The contact is configured to connect to a mating contact of a mating connector housing. The contact includes a body section having a contact retention member thereon. The contact retention member includes a bulge portion flared outward in a direction transverse to the body section. When the contact is loaded into the housing and the contact retention member is received by the channel, the bulge portion frictionally engages at least one of the inner walls of the contact-receiving chamber. The frictional engagement of the bulge portion to at least one of the inner walls secures the contact within the connector housing. The bulge portion may define an outer envelope of the contact retention member that is both greater than a predetermined thickness of the body section and wider than the channel in the contact-receiving chamber.

Optionally, the contact retention member can have multiple bulge portions flared in opposite directions form one another, or, alternatively, the contact retention member can have a series of rectangular boxes punched in opposite sides of the body section.

The connector housing may have multiple contact-receiving chambers with multiple contacts secured therein. Also, any of the contacts may have a pair of body sections aligned parallel to one another. Correspondingly, the contact-receiving chamber may have two channels separated by a rail for receiving the two contact retention members on the pair of body sections.

The main advantageous feature of certain embodiments of the invention is that the contact can be securely installed in the connector housing. The contact cannot move freely within the connector housing. The connector housing with the contact can be dropped onto a printed circuit board without the contact moving relative to the connector housing, thus, allowing solder tails of the contact to properly fit into corresponding holes on the printed circuit board. Also, the contact remains fixed in place during wave soldering of the solder tails to the printed circuit board, allowing for good solder connections that easily can be identified by visual inspection. Additionally, because the contact remains fixed in place, there is less wear and tear of the power contact from normal forces during mating and unmating of connector housings.

These and other features and embodiments of the present invention are discussed or apparent in the following detailed description of embodiments of the invention.

The foregoing summary, as well as the following detailed description of certain embodiments of the present invention, will be better understood when read in conjunction with the appended drawings. It should be understood, however, that the present invention is not limited to the arrangements and instrumentality shown in the attached drawings.

DETAILED DESCRIPTION OF THE INVENTION

Figure 1:
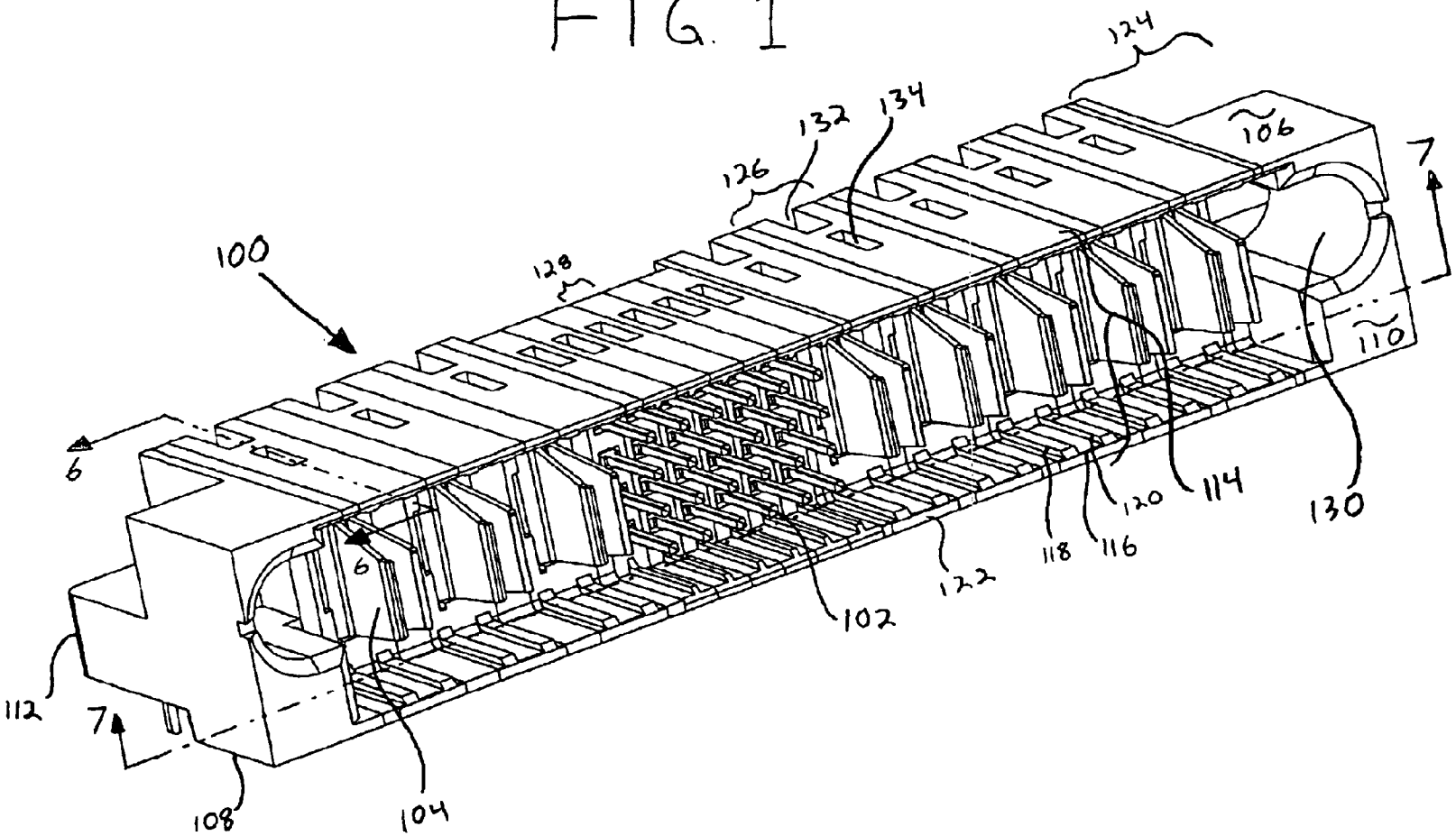
FIG. 1 illustrates a top front perspective view of a connector housing with installed signal contacts and power contacts formed in accordance with an embodiment of the present invention.

FIG. 1 illustrates a connector housing 100 with a plurality of signal contacts such as signal contact 102 and a plurality of power contacts such as power contact 104 installed therein in accordance with an embodiment of the present invention. The connector housing 100 includes a top surface 106, a bottom surface 108, a front face 110, and a back face 112. The front face 110 includes mating chambers, such as mating chamber 114, defined therein. The mating chamber 114 has a bottom wall 116 that includes ribs 118, 120 extending away from a bottom edge 122 in a direction perpendicular to the front face 110 and parallel to the bottom surface 108.

The connector housing 100 is divided into modules or sections that are arranged side by side such as guide section 124, power contact retention section 126, and signal contact retention section 128. The connector housing 100 includes a plurality of guide sections 124, a plurality of power contact retention sections 126, and a plurality of signal contact retention sections 128. Guide sections 124 include guide holes such as guide hole 130 for receiving a guide probe of a mating connector housing. The guide sections 124 guide the connector housing 100 during mating with a connector housing mate so that power contacts 104 and signal contacts 102 in the connector housing 100 properly engage receiving holes and chambers of the mating connector housing. The guide sections 124 also allow for the connector housing 100 to mate in only a desired mating configuration with the mating connector housing. The signal contact retention sections 128 are occupied by the installed signal contacts 102. The power contact retention sections 126 include notches and windows such as notch 132 and window 134, respectively, located on the top surface 106 of the connector housing 100. The notches 132 and windows 134 allow for enhanced heat dissipation during use.

Figure 2:
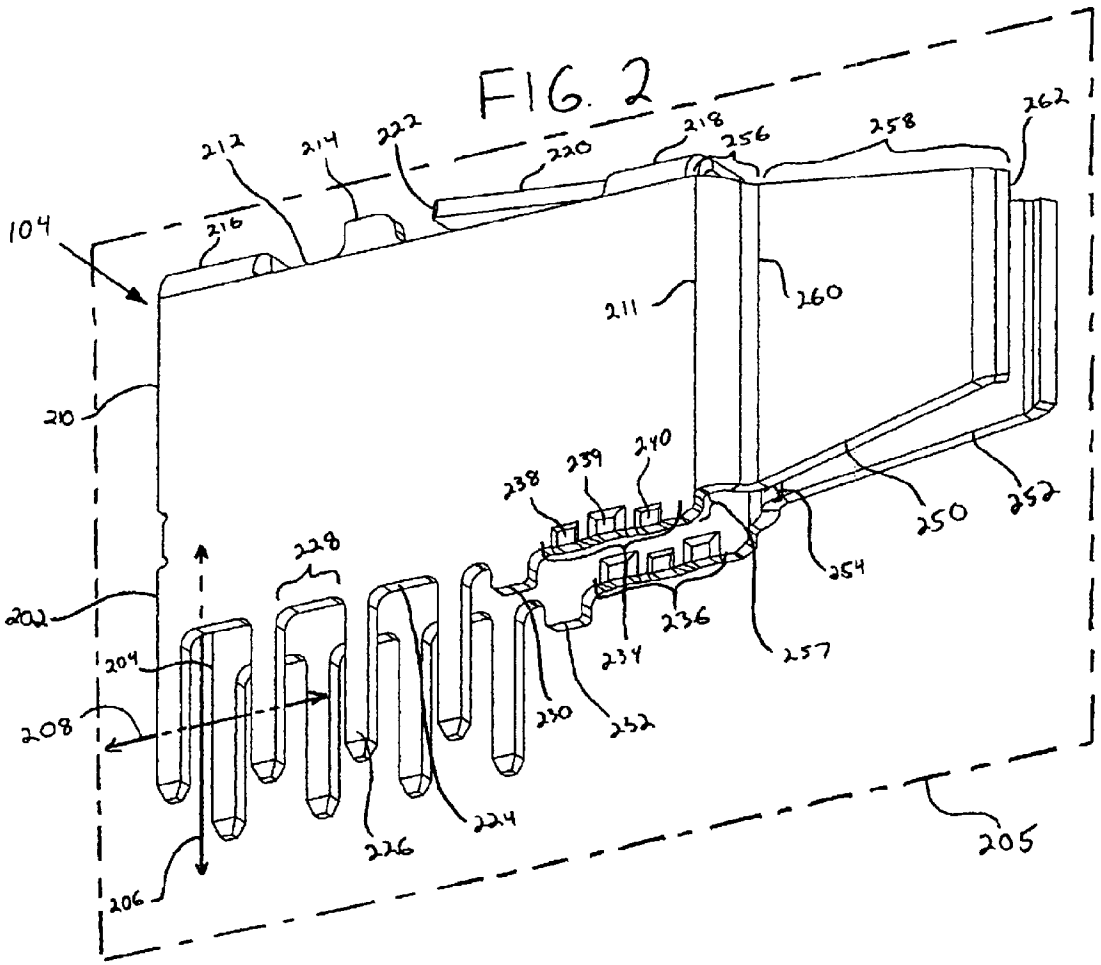
FIG. 2 illustrates a bottom front perspective view of a power contact formed in accordance with an embodiment of the present invention.

FIG. 2 illustrates a power contact 104 formed in accordance with an embodiment of the present invention. The power contact 104 includes two body sections 202, 204 generally of rectangular shape and arranged parallel to one another. The body sections extend parallel to and on opposite sides of a center plane 205 that includes axes 206, 208. The body sections 202, 204 are mirror images of each other and are located symmetrically about the center plane 205. Given to similar structure, only one body section 202 is explained hereafter.

The body section 202 includes a tail end 210 located at the rear of the body section 202 and a lead end 211 located at the front thereof. The body section 202 includes a top edge 212 running from the tail end 210 to the lead end 211. The top edge 212 includes a stabilizing projection 214 projecting upward from a middle of the top edge 212. A rear adjoining strip 216 is located proximate the tail end 210 and a front adjoining strip 218 is located proximate the lead end 211. The adjoining strips 216, 218 join and hold the two body sections 202, 204 in a particular relation to one another. The front adjoining strip 218 includes a latch 220 extending rearward, and at an angle slightly upward, from the front adjoining strip 218. The latch 220 includes an engaging surface 222 located on the end of the latch 220 distal to the front adjoining strip 218. The latch 220 helps secure the power contact 104 in the connector housing 100 by extending into the window 134 and engaging the window 134 at the engaging surface 222 of the latch 220.

The body section 202 includes a bottom edge 224 running from the tail end 210 to the lead end 211. The bottom edge 224 includes four solder tails such as solder tail 226 along the bottom edge 224 spaced at intervals such as interval 228 and extending downward in a direction perpendicular to the bottom edge 224 and parallel to the center plane 205. The bottom edge 224 includes a positioning projection 230 protruding downward therefrom. The body section 204 also includes a positioning projection 232.

The body sections 202, 204 include contact retention members 234, 236 located along and just above the bottom edge 224 proximate the lead end 211. The contact retention member 234 includes a series of bulge portions 238–240 forming a wave along the bottom edge 224. The bulges 238–240 are created by a stamping process. A first bulge 238 and a third bulge 240 protrude from the body section 202 inward toward the body section 204. A second bulge 239 protrudes from the body section 202 outward in a direction opposite of the direction in which the first and third bulges 238, 240 protrude. The contact retention member 236 includes a series of bulges that mirror the contact retention member 234.

The power contact 104 includes two lead sections 250, 252 that mirror each other and are located symmetrically about the center plane 205. The power contact 104 includes a gap 254 between the two lead sections 250, 252. The lead sections 250, 252 are attached to and extend forward from the lead ends 211 of the body sections 202, 204. The lead sections 250, 252 are attached to the lead ends 211 so that the lead sections 250, 252 are displaced upward from the bottom edges 224 of the body sections 202, 204 by a step 257. The lead sections 250, 252 include a transition flange 256 and a blade 258. The transition flange 256 is attached to the lead end 211 of the body section 202. The transition flange 256 extends forward from the lead end 211 bending initially toward the center plane 205 and then away from the center plane 205. The blade 258 includes a rear end 260 and a front end 262. The blade 258 is attached to the transition flange 256 at the rear end 260 of the blade 258. The front end 262 is shorter than the rear end 260.

Figure 3:
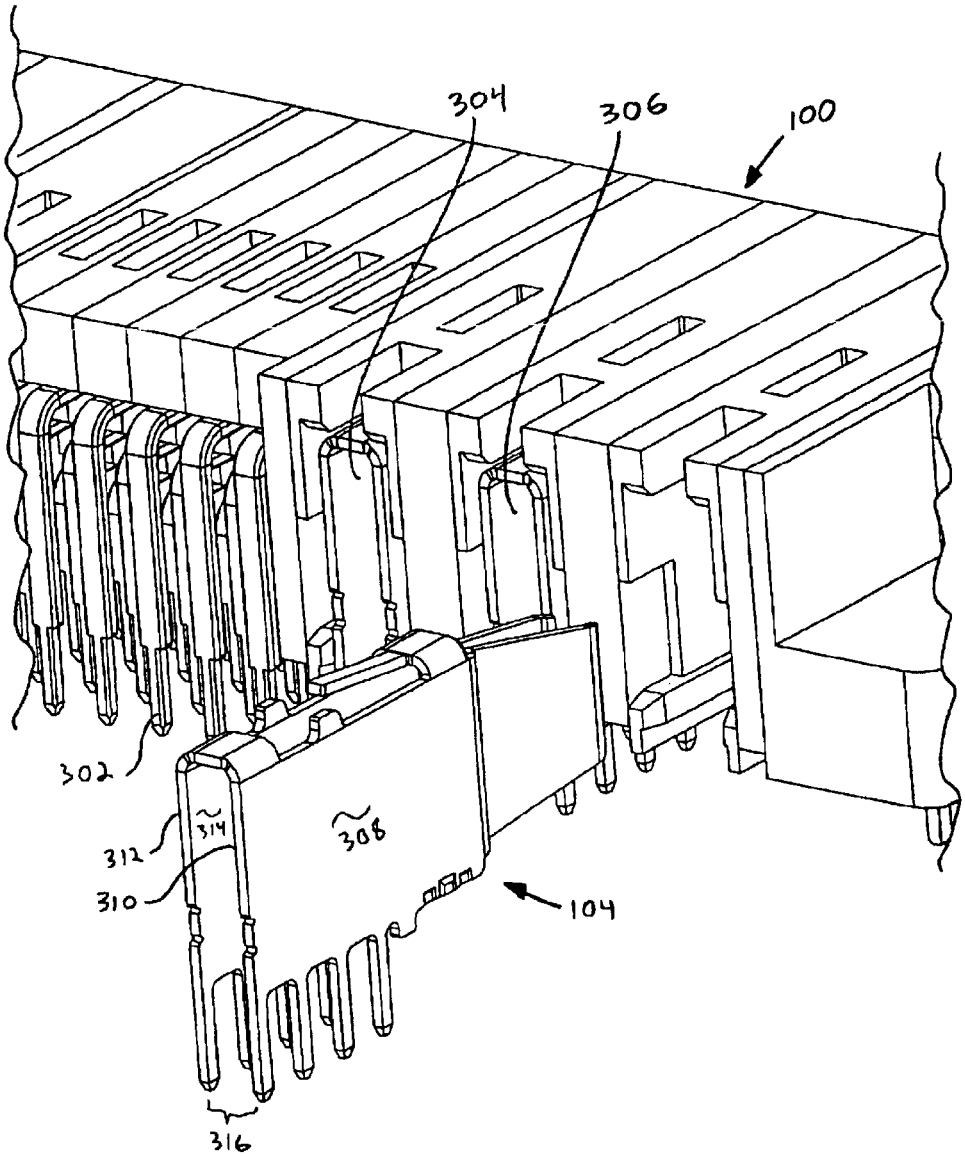
FIG. 3 illustrates a top back perspective view of a portion of a connector housing with installed signal contacts, installed power contacts, and one uninstalled power contact formed in accordance with an embodiment of the present invention.

FIG. 3 illustrates a rear view of a portion of the connector housing 100 with installed signal contacts such as signal contact 302, installed power contacts 304, 306, and uninstalled power contact 104. The body section 202 includes a right exterior surface 308 and a right interior surface 310. The body section 204 includes a left exterior surface 312 and a left interior surface 314. The body sections 202, 204 are separated by a width 316.

Figure 4:
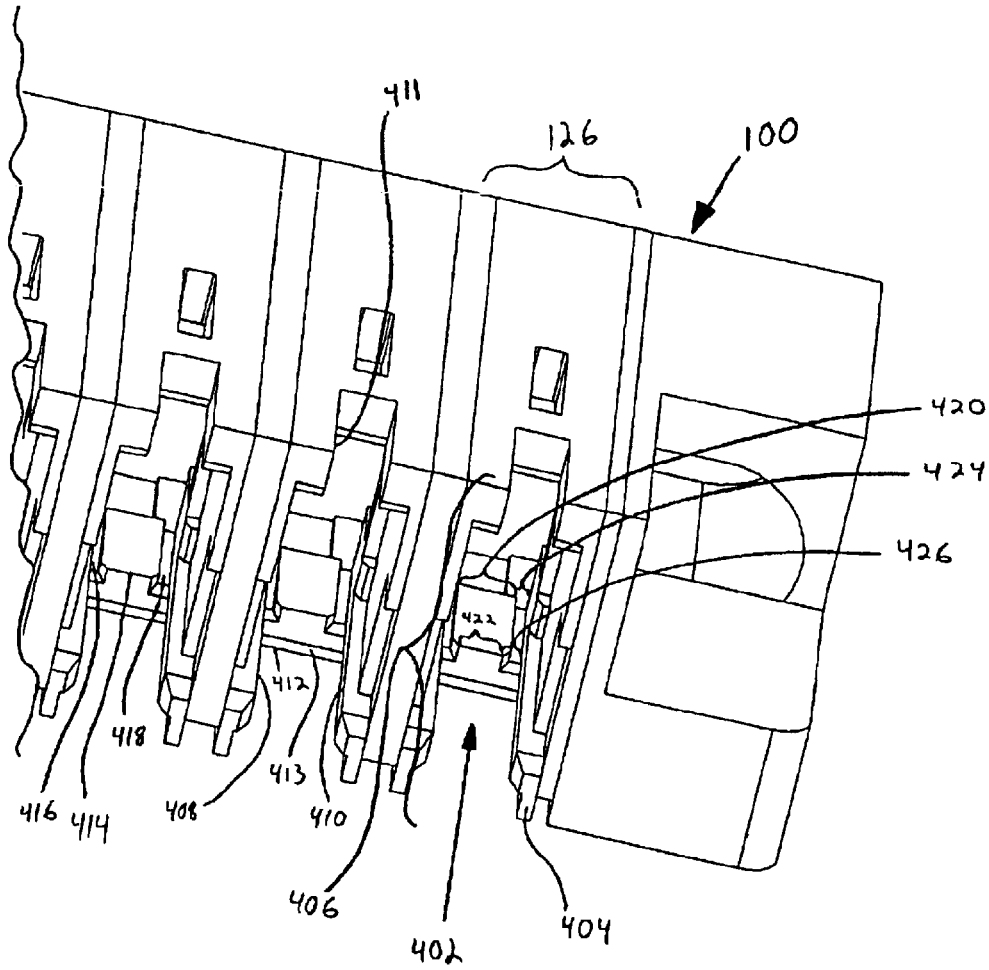
FIG. 4 illustrates a top back perspective view of a portion of a connector housing formed in accordance with an embodiment of the present invention.
Figure 5:
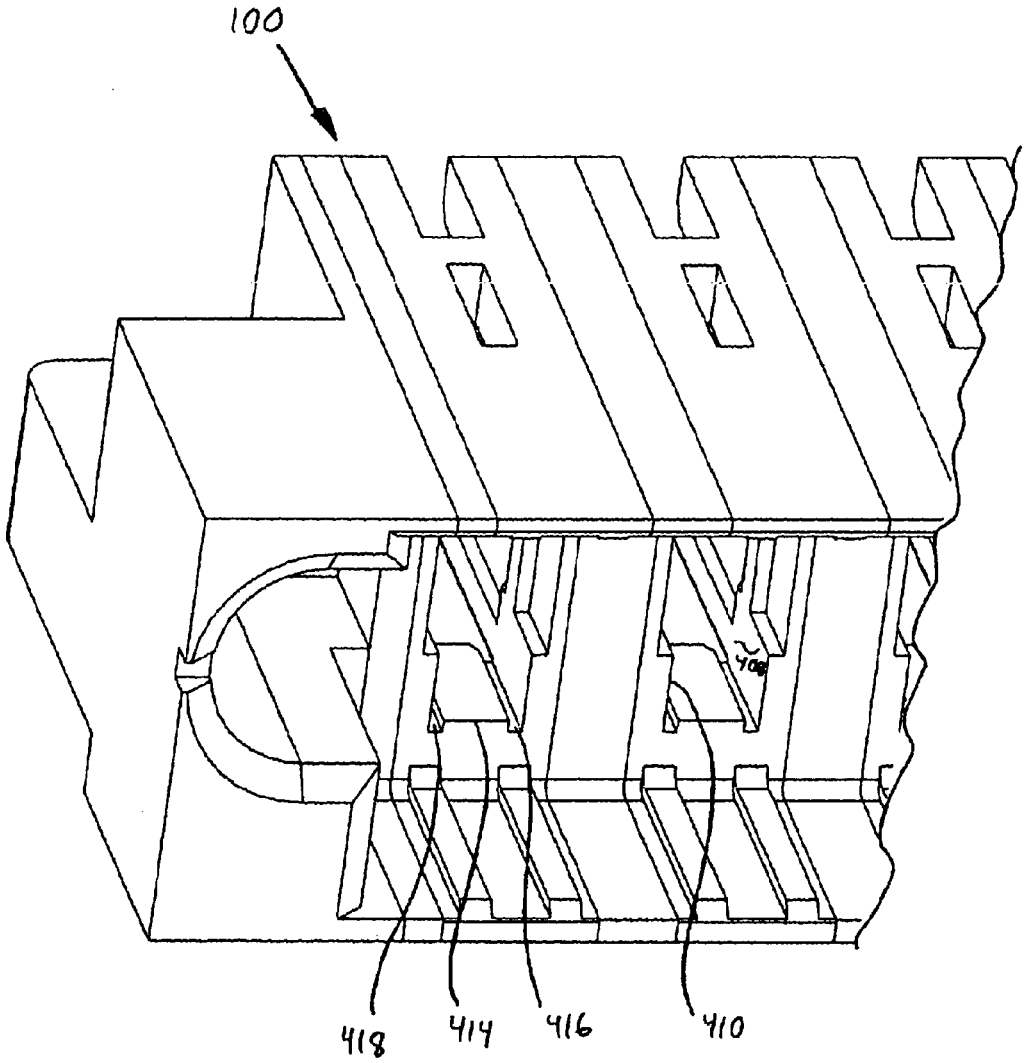
FIG. 5 illustrates a top front perspective view of a portion of a connector housing formed in accordance with an embodiment of the present invention.

FIGS. 4 and 5 illustrate a portion of the connector housing 100 in which the power contact 104 is to be installed. Each power contact retention section 126 includes a contact-receiving chamber 402 located therein and having a rear wall 404 opening onto a loading end 406 located at the rear of the power contact retention section 126. Power contacts 104 are loaded through the loading end 406. The contact-receiving chamber 402 is defined by inner walls 408, 410, a top wall 411, and a bottom wall 412. The bottom wall 412 includes a rear edge 413. A rail 414 is provided along the bottom wall 412 of the contact-receiving chamber 402 and is spaced from the inner walls 408, 410 to define channels 416, 418 running along opposite sides of the rail 414 for receiving contact retention members 234, 236. The rail 414 includes a general rail width 420 and a narrower loading-end rail width 422 to form a general channel width 424 and a wider loading-end channel width 426 for each of the channels 416, 418.

Figure 6:
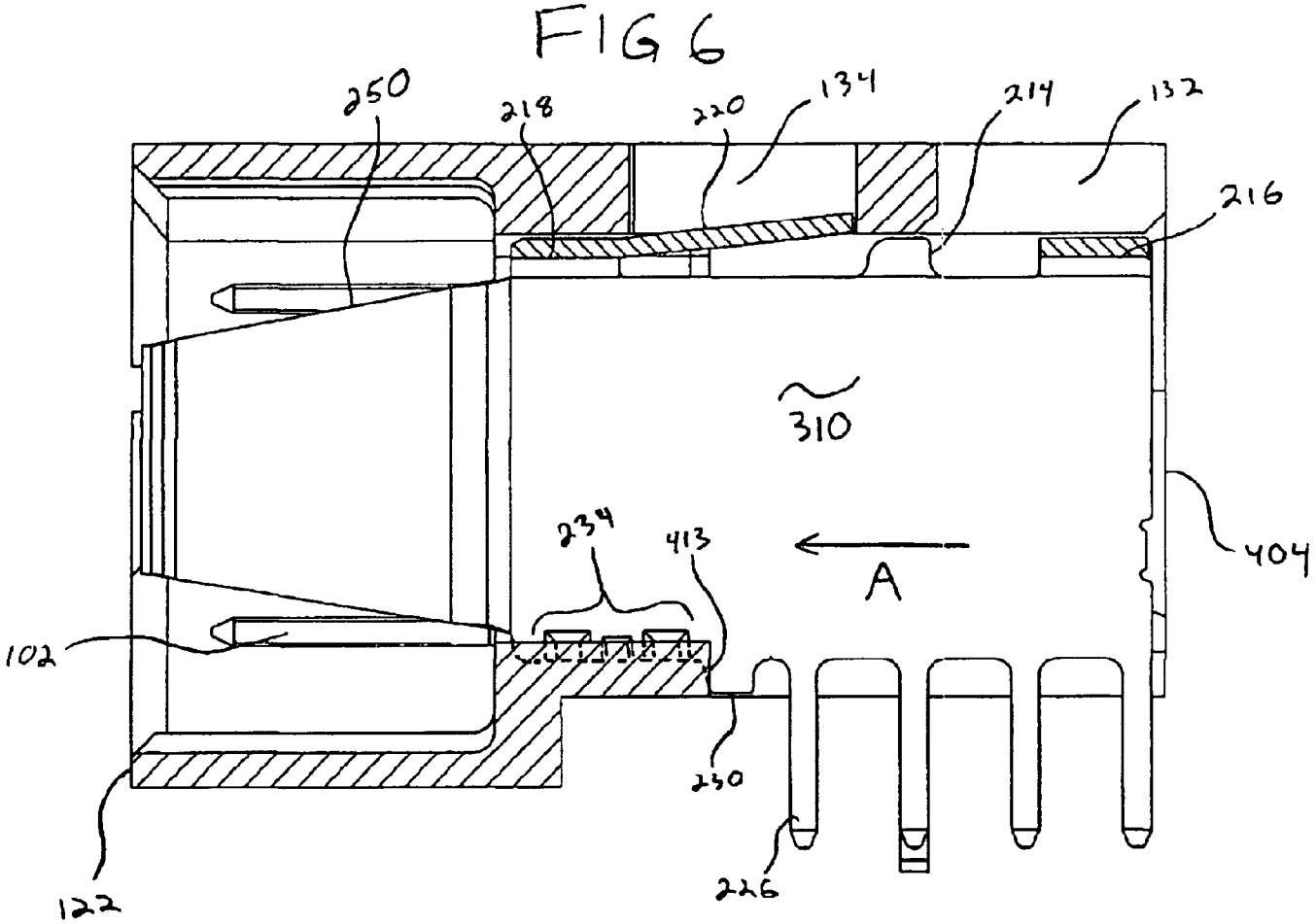
FIG. 6 illustrates a cross-sectional view taken along line 6—6 in FIG. 1 of a connector housing with an installed power contact formed in accordance with an embodiment of the present invention.
Figure 7:
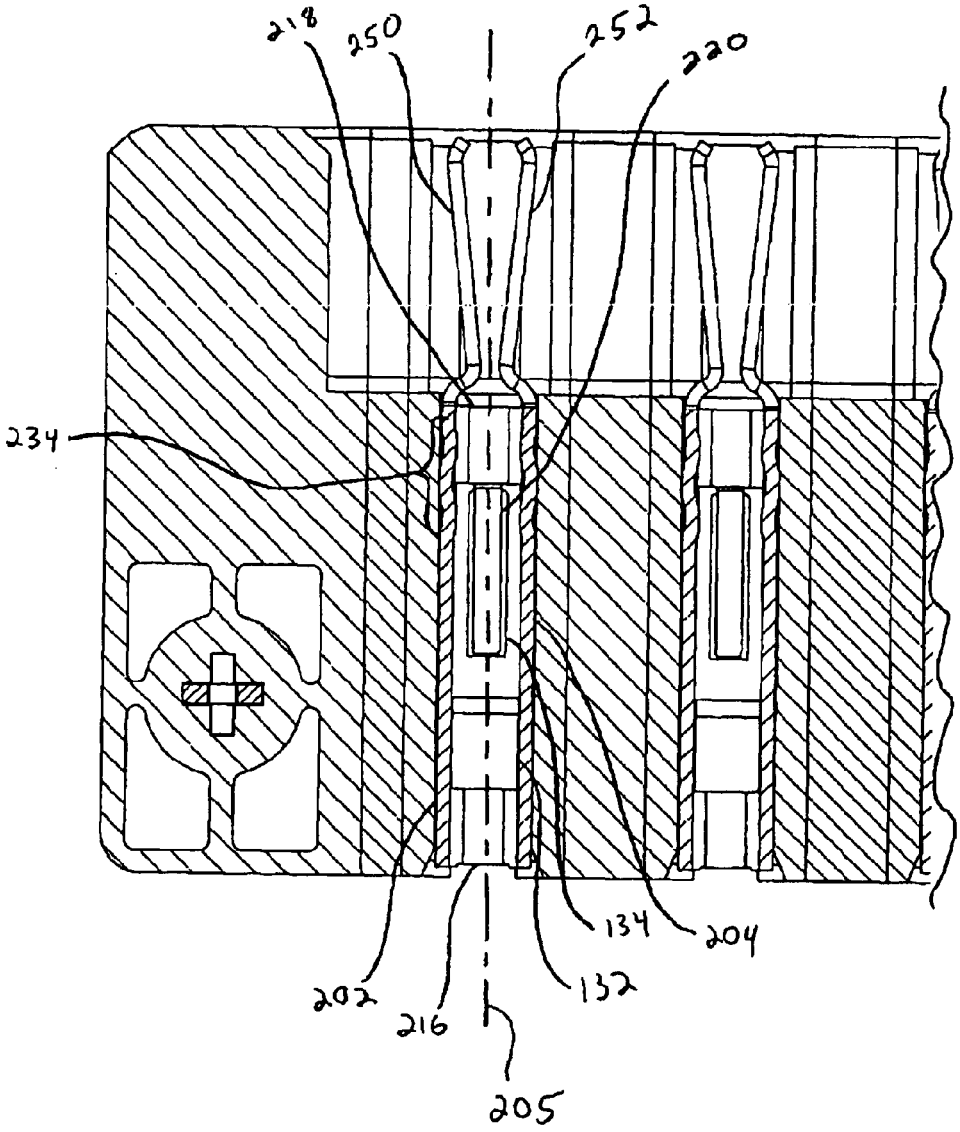
FIG. 7 illustrates a cross-sectional view taken along line 7—7 in FIG. 1 of a connector housing with two installed power contacts formed in accordance with an embodiment of the present invention.
Figure 8:
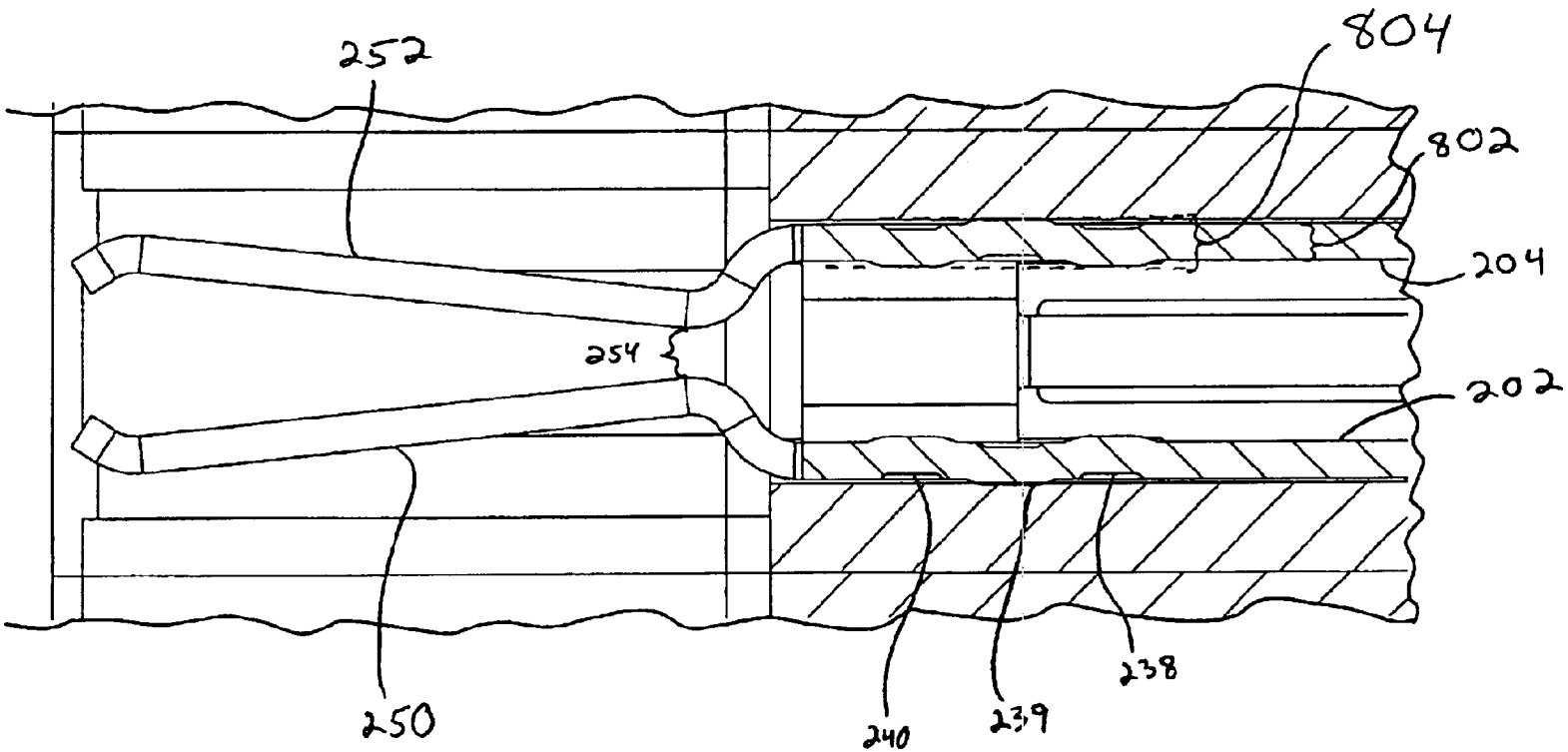
FIG. 8 illustrates a cross-sectional view taken along line 7—7 in FIG. 1 of a connector housing with one installed power contact formed in accordance with an embodiment of the present invention.

FIGS. 6–8 illustrate side and end sectional views of the power contact 104 loaded into the connector housing 100. The body sections 202, 204 have a predetermined thickness 802. The bulges 238–240 define a lateral envelope 804 for the contact retention members 234, 236 that is greater than the predetermined thickness 802 of the body sections 202, 204. The lateral envelope 804 also is thicker than the general channel width 424 of the channels 416, 418.

The power contact 104 is loaded into the contact-receiving chamber 402 through the loading end 406 so that the lead sections 250, 252 of the power contact 104 protrude forward into the contact-receiving chamber 402 toward the front face 110. Because the lead sections 250, 252 are displaced upward from the bottom edge 224 of the body sections 202, 204 by a step 257, the lead sections 250, 252 freely pass above the rail 414 and the channels 416, 418 during loading of the power contact 104. As the power contact 104 is loaded in the direction of arrow A, the contact retention members 234, 236 are guided into the channels 416, 418 through the wider loading-end channel width 426. The power contact 104 moves forward into the contact-receiving chamber 402 until the positioning projections 230, 232 of the body sections 202, 204 engage the rear edge 413 of the bottom wall 412 to stop advancement of the power contact 104. During loading of the power contact 104, because the latch 220 is angled slightly upward from the front adjoining strip 218, the latch 220 must deflect downward in order to travel under the top wall 411 of the contact-receiving chamber 402. The latch 220 remains deflected downward until entering the window 134. The notch 132 allows the power contact 104 to be loaded into the contact-receiving chamber 402 with less resistance because the notch 132 reduces the distance along the underside of the top wall 411 that the latch 220 must travel deflected downward. Once loaded, the latch 220 is accessible through the window 134 in the power contact retention section 126. The engaging surface 222 of the latch 200 engages the window 134, helping secure the power contact 104 within the connector housing 100.

Upon installation, the contact retention members 234, 236 frictionally engage the rail 414 and inner walls 408, 410 of the contact-receiving chamber 402. Friction between the contact retention members 234, 236, the rail 414, and the inner walls 408, 410 secures the power contact 104 in the connector housing 100. Also upon installation, the stabilizing projections 214 are positioned just below the top wall 411 of the contact-receiving chamber 402. The stabilizing projections 214 prevent the power contact 104 from displacing upward and, therefore, prevent the contact retention members 234, 236 from rising up out of the channels 416, 418.

Optionally, because the contact retention members 234, 236 sufficiently secure the power contact 104 in the connector housing 100, the latch 220 is not necessary and may be removed. Removal of the latch 220 allows for greater cooling through the window 134 during operation.

Figure 9:
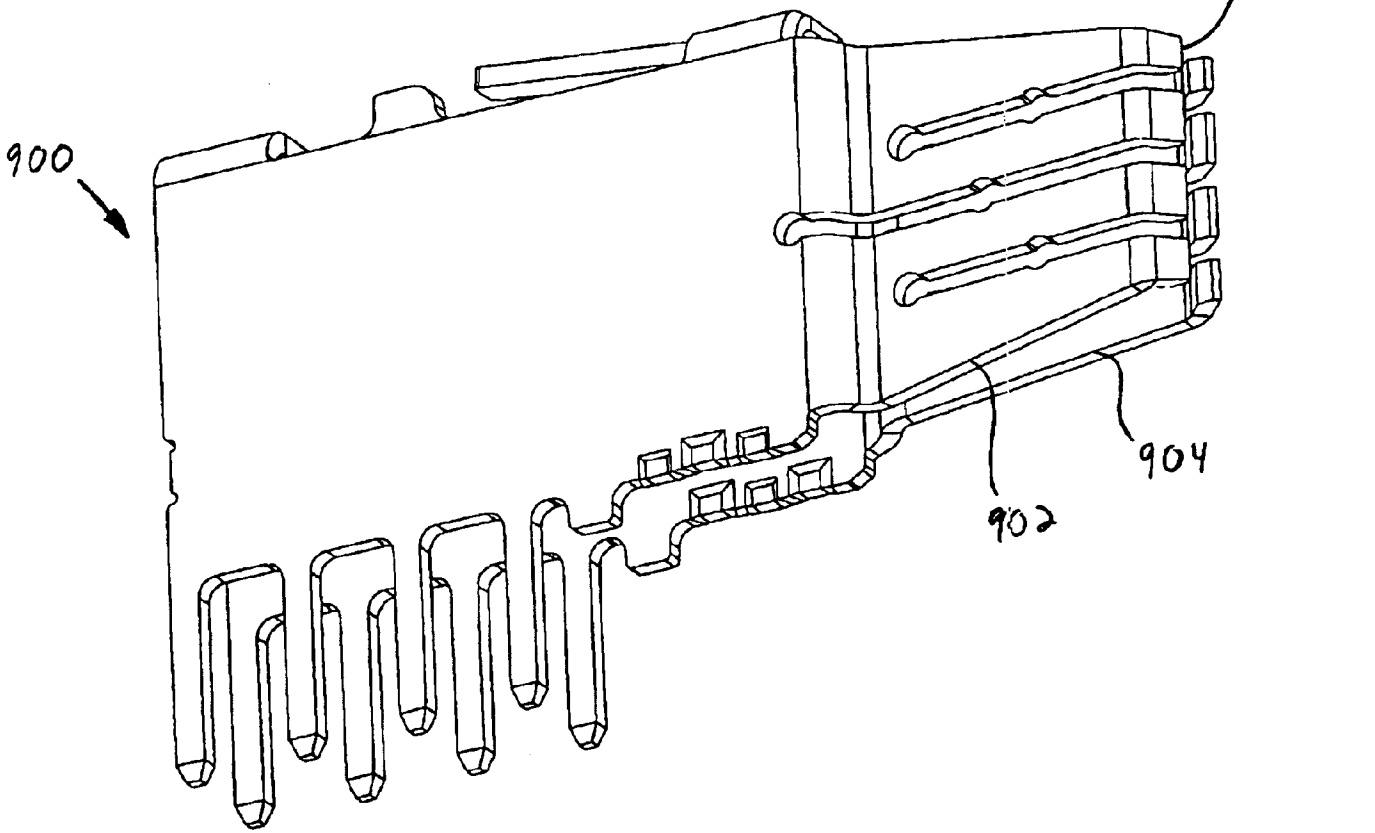
FIGS. 9–13 illustrate bottom front perspective views of power contacts in accordance with embodiments of the present invention.

FIG. 9 illustrates a power contact 900 in accordance with an embodiment of the present invention. The power contact 900 includes two lead sections 902, 904. Each of the lead sections 902, 904 include four beams such as beam 906.

Figure 10:
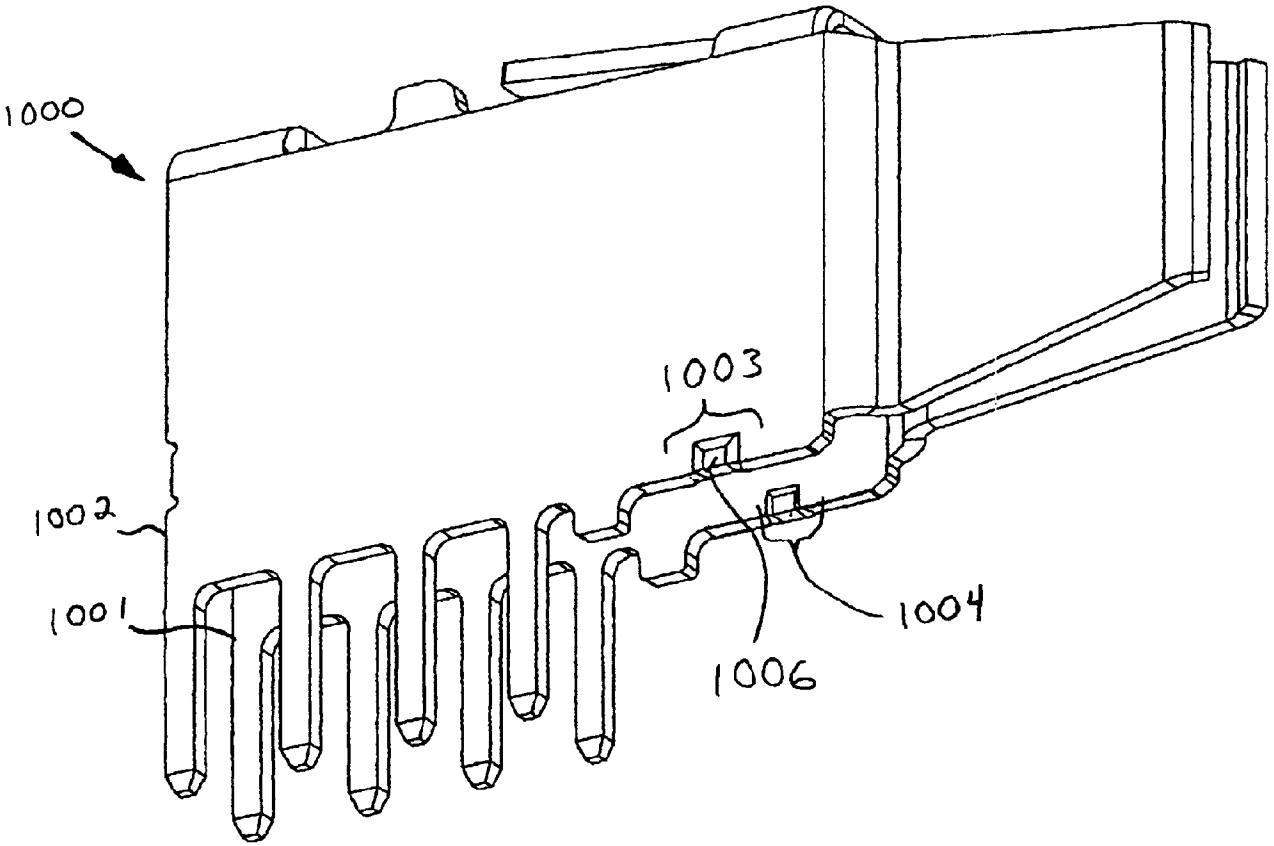

FIG. 10 illustrates a power contact 1000 in accordance with an embodiment of the present invention. The power contact 1000 includes two body sections 1001, 1002. The body sections 1001, 1002 include contact retention members 1003, 1004. The contact retention member 1003 includes only one bulge 1006 that protrudes from the body section 1002 in a direction away from both of the body sections 1001, 1002. The contact retention member 1004 includes a bulge that mirrors the contact retention member 1003.

Figure 11:
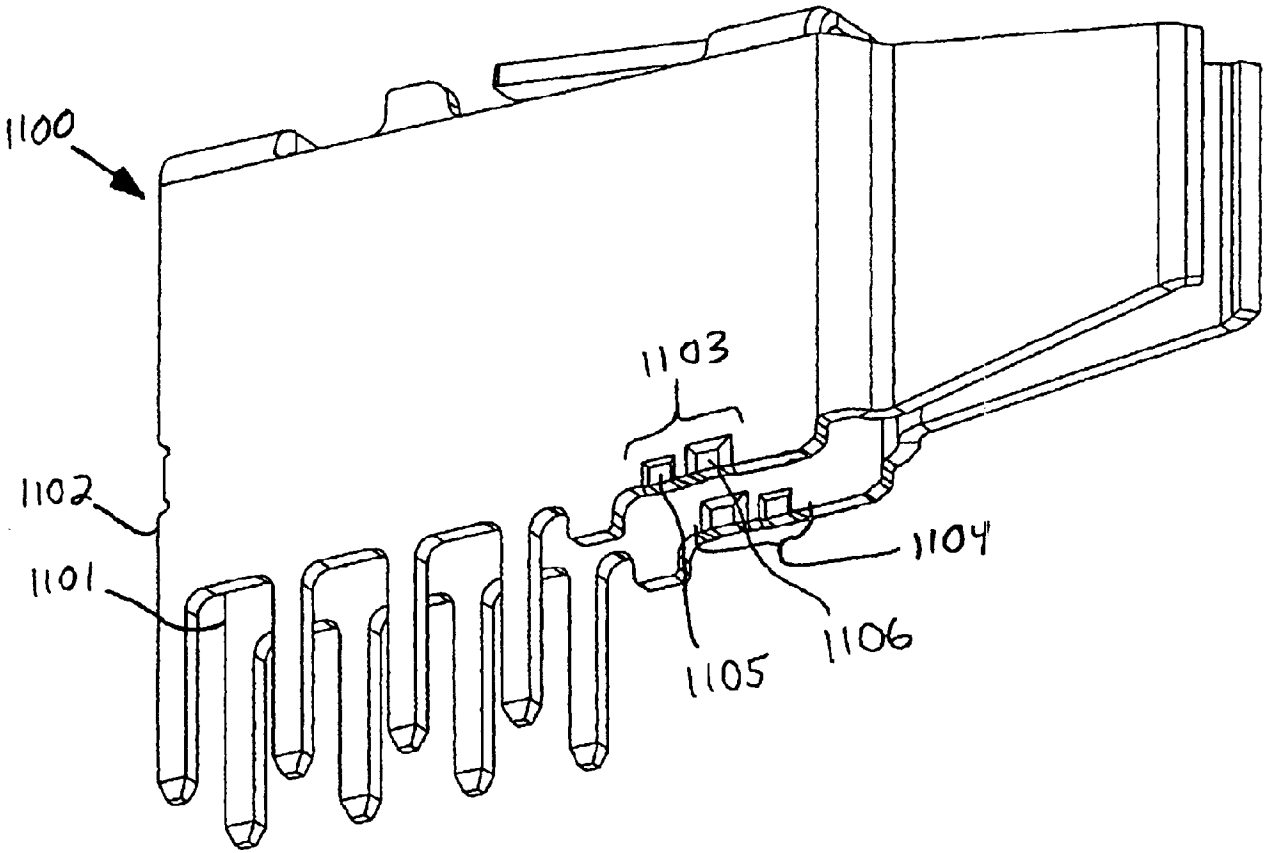

FIG. 11 illustrates a power contact 1100 in accordance with an embodiment of the present invention. The power contact 1100 includes two body sections 1101, 1102. The body sections 1101, 1102 include contact retention members 1103, 1104. The contact retention member 1103 includes a series of bulges 1105, 1106. A first bulge 1105 protrudes from the body section 1102 inward toward the body section 1101. A second bulge 1106 protrudes from the body section 1102 outward in a direction opposite of the direction in which the first bulge 1105 protrudes. The contact retention member 1104 includes a series of bulges that mirrors the contact retention member 1103.

Figure 12:
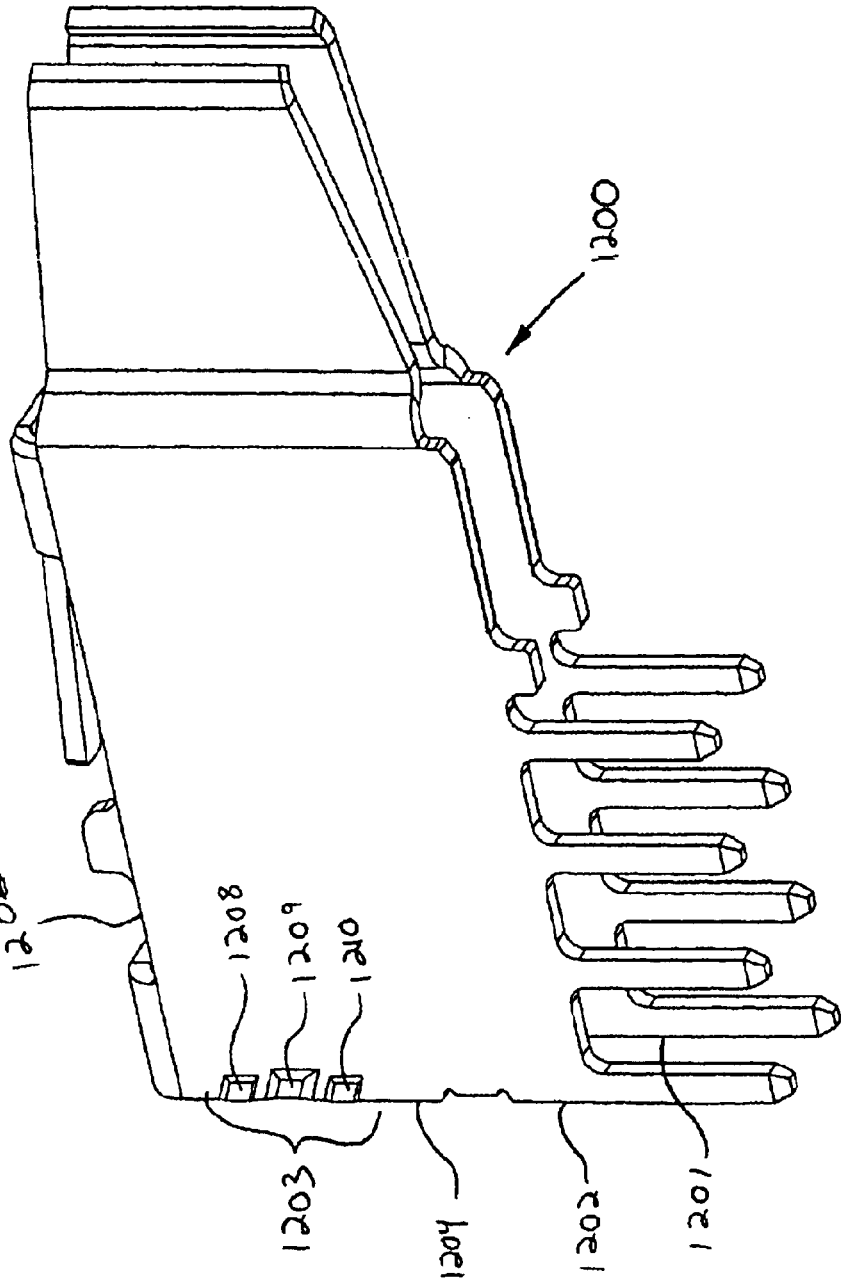

FIG. 12 illustrates a power contact 1200 in accordance with an embodiment of the present invention. The power contact 1200 includes two body sections 1201, 1202. The body section 1202 includes a contact retention member 1203. The contact retention member 1203 is located along a tail end 1204 of the body section 1202 proximate an upper edge 1206 of the body section 1202. The contact retention member 1203 includes a series of bulges 1208–1210. A first bulge 1208 and a third bulge 1210 protrude from the body section 1202 inward toward the body section 1201. A second bulge 1209 protrudes from the body section 1202 outward in a direction opposite of the direction in which the first and third bulges 1208, 1210 protrude.

Figure 13:
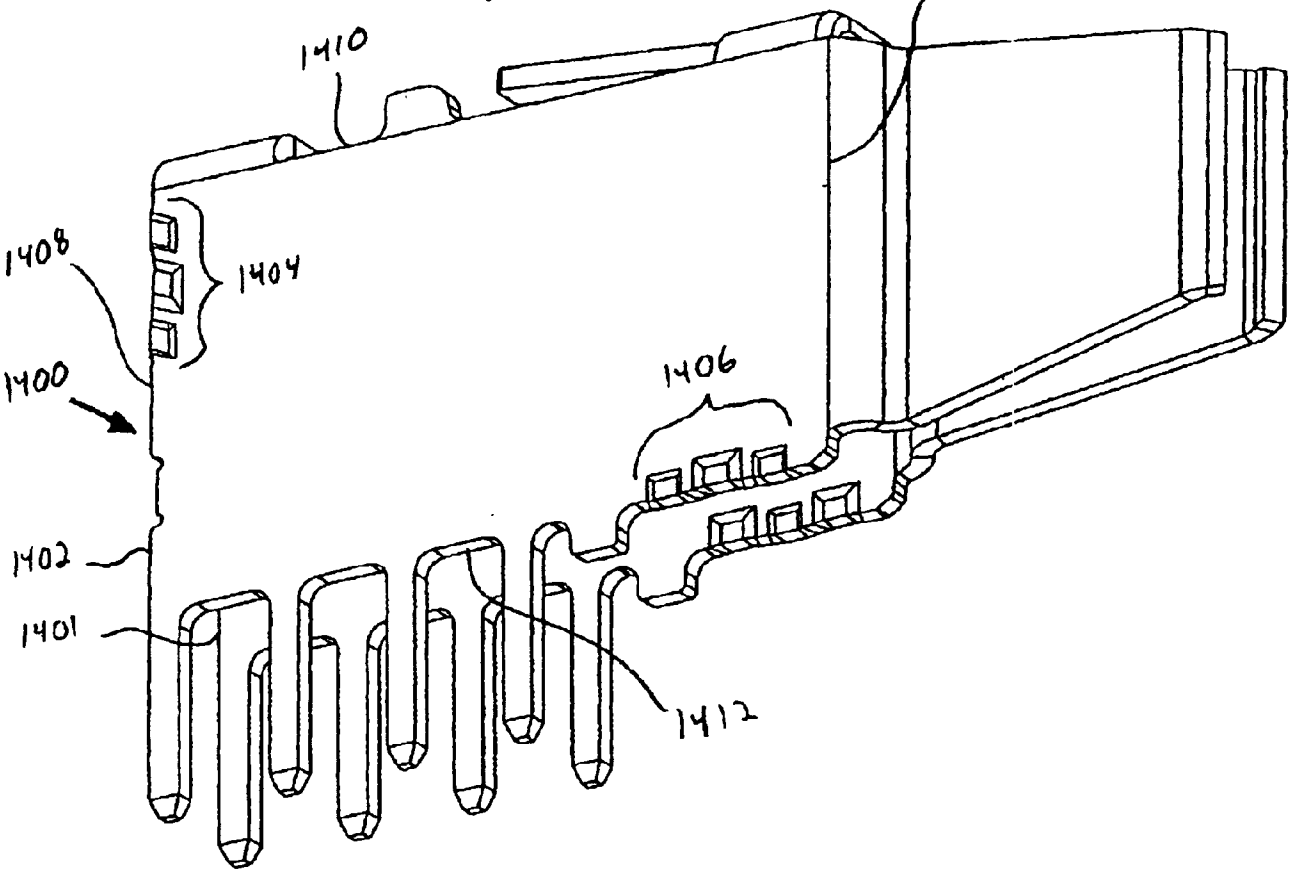

FIG. 13 illustrates a power contact 1400 in accordance with an embodiment of the present invention. The power contact 1400 includes two body sections 1401, 1402. The body section 1402 includes two contact retention members 1404, 1406. The contact retention member 1404 is located along a tail end 1408 of the body section 1402 proximate an upper edge 1410 of the body section 1402. The contact retention member 1406 is located along a bottom edge 1412 of the body section 1402 proximate a lead end 1414 of the body section 1402.

While certain embodiments of the present invention employ the power contacts having two body sections, other embodiments may include the power contacts with only one body section or more than two body sections.

While certain embodiments of the present invention employ the contact retention members having one bulge, two bulges, and three bulges, the number of bulges is in no way limited to one, two, or three.

While certain embodiments of the present invention employ contact retention members positioned at certain locations on the power contact, other embodiments may include contact retention members positioned at other locations on the power contact.

While certain embodiments of the present invention employ body sections having one contact retention member and body sections having two contact retention members, other embodiments may include body sections with three or more contact retention members.

While certain embodiments of the present invention employ bulges that are rectangular in shape, the shape of the bulges is in no way limited to a rectangular shape.

While certain embodiments of the present invention employ solder tails, alternatively, press-fit tails could be employed. Press-fit tails can be press-fitted into a pattern of corresponding receiving holes on a printed circuit board. Frictional forces retain the press-fit tails in the corresponding pattern of receiving holes in the printed circuit board.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A connector comprising:

a housing having inner walls defining a contact receiving chamber therein, said contact receiving chamber including a friction surface provided on one of said inner walls; and a contact comprising:

a connecting section configured to connect with a mating contact; and first and second body section extending substantially parallel to one another, each of said first and second body sections being substantially planar, and each of said body sections a first side surface;

a second side surface opposite said first side surface;

at least one solder tail extend in a coplanar with said first and second side surfaces; and a contact retention member having first and second bulge portions outwardly flared in respective directions transverse to said first and second side surfaces, said bulge portions frictionally engaging one of said inner walls to provide a retention force between said contact and housing.

2. The connector of claim 1, wherein each of said first and second body sections formed with a predetermined thickness between said first surface and said second surface, said at least one bulge portion defining a lateral envelope for said contact retention member that is greater than paid predetermined thickness.

3. The connector of claim 1, wherein each of said first and second body sections includes a series of buldge portions formed in sides of each of said body sections.

4. The connector of claim 1, wherein said contact receiving chamber includes a rail extending along one of said inner walls, said rail defining first and second channels along opposite sides thereof securely retaining said contact retention member.

5. The connector of claim 1, wherein said contact receiving chamber includes a rail extending along one of said inner walls, said rail being frictionally secured between said two body sections.

* * * * *